US007188549B2

(12) United States Patent
Ohtake et al.

(10) Patent No.: US 7,188,549 B2
(45) Date of Patent: Mar. 13, 2007

(54) AXIAL-FORCE-DETECTIVE FASTENING TOOL, BOLT, AND METHOD OF MANUFACTURING BOLT

(75) Inventors: Youhei Ohtake, Tokyo (JP); Fumitaka Saigo, Tokyo (JP); Hirofumi Hase, Tokyo (JP)

(73) Assignee: Sannohashi Co., Ltd., Tokyo (JP)

( * ) Notice: Subject to any disclaimer, the term of this patent is extended or adjusted under 35 U.S.C. 154(b) by 8 days.

(21) Appl. No.: 11/071,784

(22) Filed: Mar. 2, 2005

(65) Prior Publication Data

US 2005/0193869 A1 Sep. 8, 2005

(30) Foreign Application Priority Data

Mar. 2, 2004 (JP) ..... 2004-057660
Feb. 16, 2005 (JP) ..... 2005-039079

(51) Int. Cl.
*B25B 17/02* (2006.01)

(52) U.S. Cl. ..... 81/57.38; 81/429

(58) Field of Classification Search ..... 81/57.38, 81/429, 467
See application file for complete search history.

(56) References Cited

U.S. PATENT DOCUMENTS 3,969,810 A * 7/1976 Pagano ..... 29/407.02
3,969,960 A * 7/1976 Pagano ..... 81/429
4,899,591 A * 2/1990 Kibblewhite ..... 73/761
5,226,327 A * 7/1993 Fassina ..... 73/761
5,343,785 A * 9/1994 Holt et al. ..... 81/57.38
5,699,703 A * 12/1997 Habele ..... 81/57.38
6,332,378 B1 * 12/2001 Loffler ..... 81/57.38
2004/0129118 A1 * 7/2004 Junkers ..... 81/429

FOREIGN PATENT DOCUMENTS

DE 4025430 A1 * 2/1992
JP 04348878 A * 12/1992
JP 2000-074764 3/2000

* cited by examiner

*Primary Examiner*—David B. Thomas
(74) *Attorney, Agent, or Firm*—Jordan and Hamburg LLP

(57) ABSTRACT

An axial-force-detective fastening tool fastens a nut to a bolt, and at the same time, detects and axial force acting on the bolt. The tool has a socket body rotatably supported with a tool body and having a nut receiver. The socket body turns a nut received in the nut receiver around an axis of the socket body, to fasten the nut to a bolt. An ultrasonic sensor is supported with the tool body, is movable along an axis of the socket body, and is brought into contact with a front end of the bolt in the nut receiver. The ultrasonic sensor emits and receives ultrasonic waves to detect an axial force acting on the bolt. A sensor spring pushes the ultrasonic sensor to the front end of the bolt. The bolt includes a reference surface which is engaged by the ultrasonic sensor and is recessed in a tapered opening in an end of the bolt.

10 Claims, 12 Drawing Sheets

81
83
85
87
89
91
93
95
97
99
101
103
105
107
109
111
113
115
117
119
121
123
125
127
129
61
65
69
73
75
77
79

AXIAL-FORCE-DETECTIVE FASTENING TOOL, BOLT, AND METHOD OF MANUFACTURING BOLT

BACKGROUND OF THE INVENTION

1. Field of the Invention

The present invention relates to an axial-force-detective fastening tool for fastening bolts and nuts to, for example, a suspension of an automobile. The present invention also relates to a bolt to be fastened with the axial-force-detective fastening tool and a method of manufacturing the bolt.

2. Description of Related Art

FIG. 12 shows an example of a conventional axial-force-detective fastening tool.

The fastening tool of FIG. 12 has a detective socket 201 removably attached to a torque wrench 203. The detective socket 201 has a socket body 205 and a stationary member 207. The socket body 205 is rotatable relative to the stationary member 207. The socket body 205 has a bolt receiving hole 209 that receives a head 212 of a bolt 211. On the back side of the bolt receiving hole 209, an ultrasonic sensor 213 is arranged.

The ultrasonic sensor 213 has a permanent magnet body 214 and a piezoelectric element 215. The piezoelectric element 215 directly comes in contact with the bolt head 212. The piezoelectric element 215 is connected to a lead wire 217, which is connected to a terminal of a slip ring 219. Another terminal of the slip ring 219 is connected to a coaxial cable 221 supported with the stationary member 207.

The torque wrench 203 has a drive shaft 223 and a ratchet mechanism 225 driven through meshing bevel gears 227 and 229. The ratchet mechanism 225 is interlinked with a shaft 231 engaging with a top end of the socket body 205 through a pin 233.

When the bolt receiving hole 209 of the socket body 205 is set on the head 212 of the bolt 211, the bolt head 212 is attracted by the magnet body 214 so that the piezoelectric element 215 is brought into contact with the top face of the bolt head 212.

Thereafter, the drive shaft 223 is driven to rotate the shaft 231 through the bevel gears 227 and 229 and ratchet mechanism 225. Together with the shaft 231, the socket body 205 rotates relative to the stationary member 207. The rotation of the socket body 205 turns the head 212 of the bolt 211 so that the bolt 211 is screwed into a block 235 to fasten an object 237.

The fastening force of the bolt 211 is controlled by managing the axial force of the bolt 211. Namely, a controller (not shown) makes the piezoelectric element 215 emit ultrasonic waves, which are reflected by a front end of the bolt 211 and are received by the piezoelectric element 215. The controller measures an elapsed time between the emission of the ultrasonic waves and the reception thereof as a round-trip time of the ultrasonic waves along an axial length of the bolt 211. Based on the round-trip time, the controller computes the axial length of the bolt 211, and then, an axial length extension ratio of the bolt 211 due to the fastening. Thereafter, the controller computes an axial force that is proportional to the extension ratio. When the axial force reaches a set value, the controller terminates the fastening of the bolt 211. As a result, the bolt 211 is correctly fastened according to an axial force acting on the bolt 211.

The related art mentioned above may be effective when directly fastening the bolt 211 to the block 235. The related art, however, is unsatisfactory when fastening a nut to the bolt 211 because the bolt 211 turns with the nut when the socket body 205 fastens the nut to the bolt 211. Namely, it is incapable for the fastening tool of the related art to fasten a nut while measuring an axial force with the fastening tool being held with one hand of an operator.

If the bolt 211 is a screw stud, a nut can be fastened to the bolt without corotation. In this case, however, a front end of the bolt turns relative to the piezoelectric element 215 when the nut is fastened, to break the piezoelectric element 215. Namely, it is practically difficult for the related art to fasten a nut while measuring an axial force acting on a bolt.

When the related art fastens a nut to a bolt, a front end of the bolt protrudes from the nut as the nut is fastened to the bolt. The ultrasonic sensor 213 fixed to the socket body 205 is unable to cope with this situation. Namely, the ultrasonic sensor 213 never allows the front end of the bolt to protrude toward the ultrasonic sensor 213.

The piezoelectric element 215 is fixed to the permanent magnet body 214. Accordingly, a face of the magnet body 214 that comes in contact with the head 212 of the bolt 211 must be aligned with a face of the piezoelectric element 215 that also comes in contact with the bolt head 212. If there is a misalignment between them, the piezoelectric element 215 may incorrectly contact the bolt head 212 when the magnetic body 214 correctly contact the bolt head 212. Namely, the magnetic body 214 and piezoelectric element 215 of the related art require very complicated and difficult assembling work.

The ultrasonic sensor 213 is fixed to the socket body 205, and therefore, the piezoelectric element 215 and controller must transfer signals between them through the socket body 205 and stationary member 207. Due to this, the lead wire 217 and coaxial cable 221 must be connected to each other through the slip ring 219. This is a complicated structure. In addition, the durability of the slip ring 219 is low.

The stationary member 207 is interposed between the socket body 205 and the torque wrench 203. When the related art is used in a car assembling process to fasten a nut to parts located at an inside position, such as a suspension slat and a knuckle arm, the socket body 205 is hardly inserted into the inside position because the stationary member 207 prevents the same. In this way, the related art has operational limits and difficulties.

SUMMARY OF THE INVENTION

The present invention has been devised to solve the problems of the related art of difficulty in correctly measuring an axial force acting on a bolt while fastening a nut to the bolt, structural complexity, and limits on durability and workability.

An object of the present invention is to provide an axial-force-detective fastening tool having an ultrasonic sensor and a pusher for pushing the ultrasonic sensor. The ultrasonic sensor is supported with a tool body, is movable along the axis of a socket body, is in a nut receiver of the socket body, comes in contact with a front end of a bolt, and emits and receives ultrasonic waves to detect an axial force acting on the bolt. The pusher pushes the ultrasonic sensor to the front end of the bolt.

In order to accomplish the object, an aspect of the present invention provides an axial-force-detective fastening tool including an ultrasonic sensor supported with a tool body, movable along the axis of a socket body, being brought into contact with a front end of a bolt in a nut receiver of the socket body, and emitting/receiving ultrasonic waves to detect an axial force acting on the bolt, and a pusher to push the ultrasonic sensor to the front end of the bolt. The socket body turns around the axis thereof to fasten the nut to the bolt. At this time, the ultrasonic sensor and the bolt do not rotate relative to each other. This prevents the breakage of the ultrasonic sensor and improves the durability thereof.

The pusher correctly resiliently brings the ultrasonic sensor into contact with the front end of the bolt, to correctly detect an axial force acting on the bolt.

When the nut is fastened to the bolt, the front end of the bolt may protrude from the nut toward the ultrasonic sensor. In this case, the ultrasonic sensor retracts into the tool body against the pushing force of the pusher, so that the nut can properly be fastened to the bolt while the axial force detection is being carried out.

The ultrasonic sensor is supported with the tool body so that wiring from the tool body to the ultrasonic sensor is directly made without a slip ring. This improves the durability of the wiring.

No stationary member is interposed between the tool body and the socket body. Even if a nut to fasten is located in a deep narrow space, the front end side of the fastening tool may be inserted into the narrow space by grasping the tool body, and the nut receiver may be set on the nut to easily fasten the nut and measure an axial force acting on a bolt to which the nut is fastened. This greatly improves workability.

The fastening tool may have an inner socket. The inner socket is nonrotatably supported with the tool body and is concentric with the socket body. The inner socket has a stopping part to stop the rotation of an engaging part formed at a front end of a bolt. The inner socket supports the ultrasonic sensor so that the ultrasonic sensor is axially movable. The inner socket prevents the bolt from rotating relative to the tool body. When the socket body is driven by a driver, a nut can easily be fastened to the bolt that is prevented from rotation.

The pusher may be interposed between the ultrasonic sensor and the inner socket. In this case, the ultrasonic sensor is supported with the inner socket through the pusher. This secures the movement of the ultrasonic sensor relative to the inner socket, so that the ultrasonic sensor is correctly resiliently brought into contact with the front end of the bolt stopped at the stopping part of the inner socket, to correctly detect an axial force acting on the bolt.

The pusher may be interposed between a lid that is fixed to the inner socket and a slider that is fixed to the ultrasonic sensor and is slidably guided in the inner socket. In this case, the slider correctly slides and guides the ultrasonic sensor along the inner socket so that the ultrasonic sensor is correctly resiliently brought into contact with the front end of the bolt stopped at the stopping part of the inner socket, to correctly detect an axial force acting on the bolt.

The inner socket may have a support hole formed through the inner socket from an outer side face thereof to the stopping part. The support hole may support a pin. An elastic member may be arranged to hold the pin so that a front end of the pin retracts from the stopping part and an outer end of the pin protrudes from the outer side face of the inner socket. A movable member may movably be supported at a front end of the inner socket. The movable member is configured so that, when pressed toward the inner socket against pushing force, the movable member pushes the outer end of the pin toward the stopping part against the force of the elastic member so that the front end of the pin protrudes from the stopping part and engages with a side of the engaging part of the bolt. When the movable member comes in contact with a nut, the movable member is pushed back to push the pin so that the front end of the pin engages with the side of the engaging part of the bolt. This configuration correctly positions the inner socket relative to the bolt and correctly resiliently brings the ultrasonic sensor into contact with the front end of the bolt stopped at the stopping part of the inner socket, to correctly detect an axial force acting on the bolt.

The inner socket is supported so as to be movable relative to the tool body. A socket pusher may be arranged so as to push the inner socket toward the bolt. When the fastening tool fastens a nut to a bolt, a front end of the bolt may protrude from the nut toward the inner socket. In this case, the inner socket moves against the pushing force of the socket pusher to continue the fastening work and carry out axial force detection with the stopping part of the inner socket stopping the rotation of the bolt and the nut receiver receiving the nut.

The inner socket may be engaged with the tool body through splines so that the inner socket may correctly move.

The stopping part of the inner socket and the engaging part of the front end of the bolt may be provided with serrations, so that the front end of the bolt is easily stopped by the inner socket and the rotation of the bolt relative to the inner socket is surely prevented.

The driver may include a drive shaft turned by an electric motor and a bevel gear mechanism arranged on the drive shaft and socket body, to transmit the rotation of the drive shaft to the socket body through meshing bevel gears. The electric motor drives the drive shaft and bevel gear mechanism to surely rotate the socket body so that the socket body fastens a nut to a bolt while preventing the bolt from rotating around the axis thereof, and at the same time, an axial force acting on the bolt is measured.

Another aspect of the present invention provides a bolt to be fastened with the axial-force-detective fastening tool mentioned above. The bolt has a front reference face that is formed at a front end of the bolt, is substantially orthogonal to an axial line of the bolt, and is brought into contact with the ultrasonic sensor. The bolt also has a slanted face formed around the front reference face, to position the ultrasonic sensor on the front reference face. The ultrasonic sensor is pushed by the pusher and is correctly brought into contact with the front reference face of the bolt. Under this state, the slanted face around the front reference face of the bolt prevents the ultrasonic sensor from being displaced in a direction orthogonal to the axis. As a result, the ultrasonic censor can correctly measure an axial force acting on the bolt.

The bolt may have a head reference face formed at a head of the bolt opposite to the front reference face, to reflect ultrasonic waves emitted from the ultrasonic sensor. The head reference face correctly reflects ultrasonic waves emitted from the ultrasonic sensor so that an axial force acting on the bolt may correctly be measured.

Still another aspect of the present invention provides a method of manufacturing the bolt mentioned above to be fastened with the axial-force-detective fastening tool mentioned above. The front reference face and slanted face of the bolt may be formed when the bolt is produced by cold forging. This easily and correctly forms the front reference face and slanted face of the bolt.

The head reference face of the bolt may be formed when the bolt is produced by cold forging. This easily and correctly forms the head reference face of the bolt.

The bolt may be formed with a circumferential groove along the engaging part of the front end of the bolt to receive a front end of a pin. The circumferential groove engages with the front end of the pin, to correctly position the inner socket with respect to the bolt.

In this way, the axial-force-detective fastening tool according to the present invention is capable of fastening a nut to a bolt while correctly measuring an axial force acting on the bolt, has improved durability and workability, and is realizable with a simple structure involving no increase in the number of parts.

BRIEF DESCRIPTION OF THE DRAWINGS

FIGS. 3A to 3C are views showing a fastening operation of the fastening tool of the first embodiment in which FIG. 3A shows the tool before setting, FIG. 3B shows the tool set on a nut to fasten, and FIG. 3C shows the tool on the completion of fastening;

FIGS. 5A to 5E are views showing a method of manufacturing a bolt by cold forging according to an embodiment of the present invention in which FIG. 5A shows a bolt base material cut from a linear material, FIG. 5B shows a first process of the cold forging, FIG. 5C shows a second process of the cold forging, FIG. 5D shows a third process of the cold forging, and FIG. 5E shows a fourth process of the cold forging;

DETAILED DESCRIPTION OF EMBODIMENTS

Figure 1:
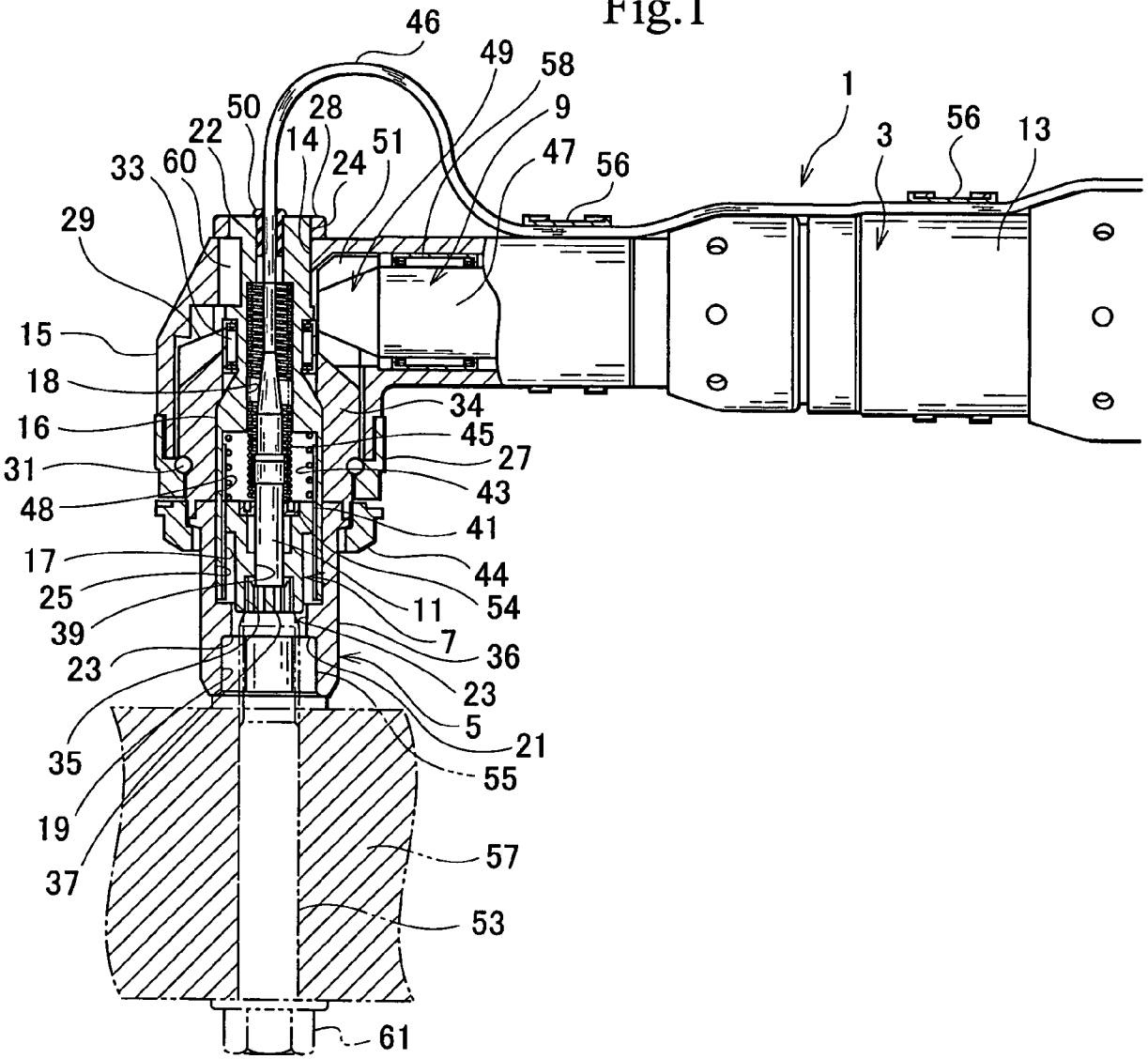
FIG. 1 is a sectional view showing essential part of an axial-force-detective fastening tool according to a first embodiment of the present invention.
Figure 2:
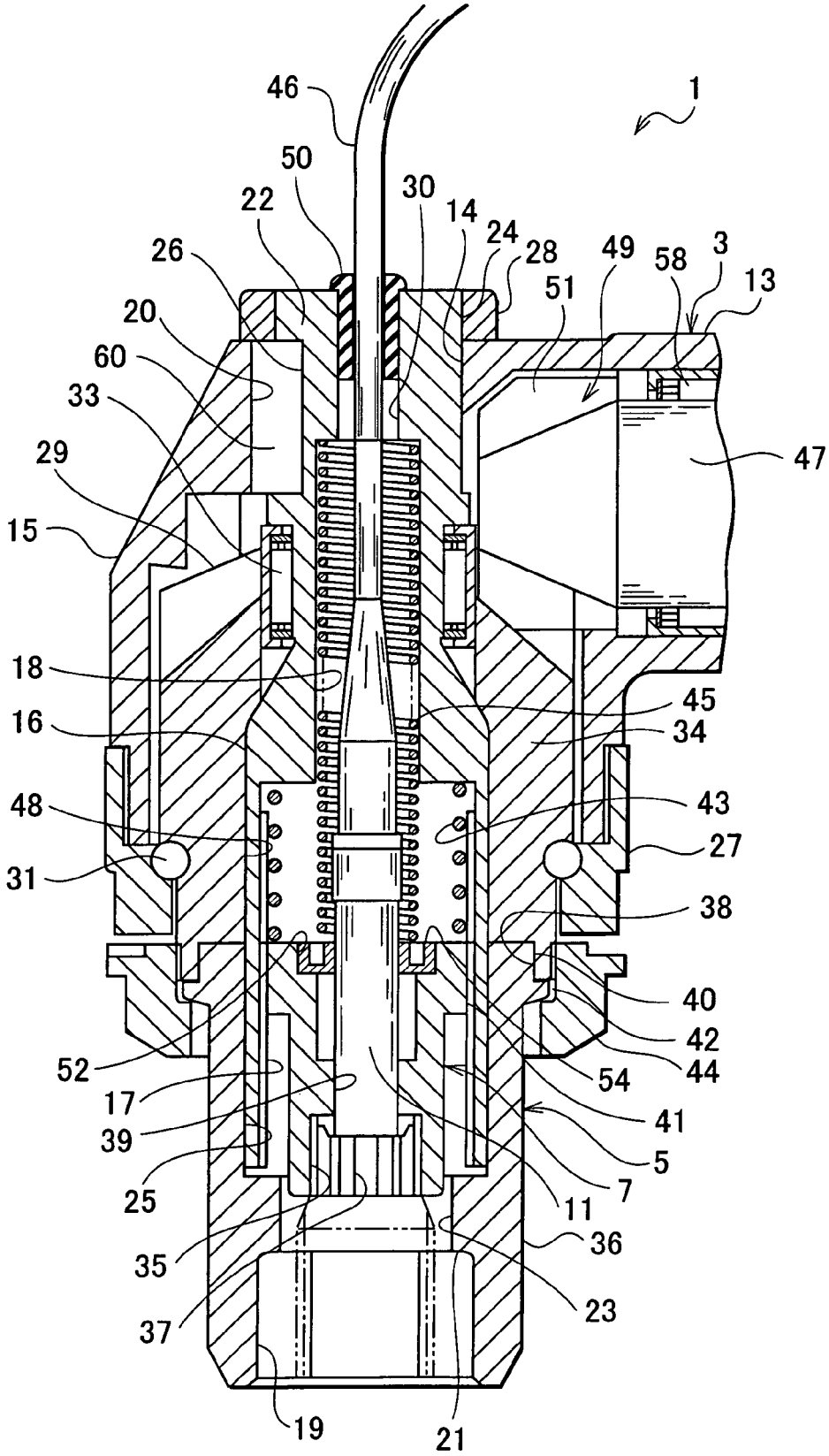
FIG. 2 is an enlarged sectional view showing the essential part shown in FIG. 1.

FIG. 1 is a sectional view showing essential part of an axial-force-detective fastening tool according to the first embodiment of the present invention and FIG. 2 is an enlarged sectional view showing the essential part shown in FIG. 1. In FIGS. 1 and 2, the axial-force-detective fastening tool 1 has a tool body 3, a socket body 5, an inner socket 7, a driver 9, and an ultrasonic sensor 11.

The tool body 3 consists of a hollow lever 13 and a hollow lever head 15 that are integral with each other. The lever 13 is hollow and is grasped with one hand of an operator. An end (not shown) of the lever 13 is provided with, for example, an electric motor (to be explained later) that is a part of the driver.

The lever head 15 has an axis orthogonal to an axis of the lever 13. Along the axis of the lever head 15, there is an inner socket support cylinder 16 that is removable from the lever head 15.

The lever head 15 has a support cylinder fitting hole 14 having a key groove 20.

The inner socket support cylinder 16 has a fitting end 22 provided with a male thread 24 and a key groove 26. The fitting end 22 is inserted into the support cylinder fitting hole 14 of the lever head 15 and is fixed with a nut 28. The fitting end 22 is nonrotatably fixed with a key 60 inserted in the key grooves 20 and 26.

An inner circumferential wall of a front end of the inner socket support cylinder 16 is provided with axially extending inner splines 17. On the depth side of the inner socket support cylinder 16, there is a spring support hole 18 that is continuous to the fitting end 22 through a through hole 30.

The socket body 5 is rotatably supported with the lever head 15 of the tool body 3. The socket body 5 consists of a rotary interlock 34 and a nut driver 36.

The rotary interlock 34 has a coupling hole 38 having, for example, a hexagonal shape. The nut driver 36 has a coupling end 40 having, for example, a hexagonal shape corresponding to the shape of the coupling hole 38. Adjacent to the coupling end 40, the nut driver 36 has a coupling flange 42. The coupling hole 38 of the rotary interlock 34 is coupled to the coupling end 40 of the nut driver 36, and a nut 44 is fastened to the rotary interlock 34 to apply fastening force on the coupling flange 42. As a result, the rotary interlock 34 and nut driver 36 are fixed together so that they do not turn relative to each other.

An end of the nut driver 36 has a nut receiver 19 to receive a nut 55. The nut receiver 19 has, for example, a hexagonal sectional shape to receive a hexagonal nut. A back wall 21 of the nut receiver 19 has an inner socket pass hole 23 having a circular section. Adjacent to the back wall 21, there is an engaging axial hole 25 that is continuous to the inner socket pass hole 23. The engaging axial hole 25 engages with the periphery of the inner socket support cylinder 16. The nut driver 36 can rotate relative to the inner socket support cylinder 16.

The rotary interlock 34 has an engaging axial hole 48 whose diameter is the same as the diameter of the engaging axial hole 25 of the nut driver 36. The engaging axial hole 48 engages with the periphery of the inner socket support cylinder 16. The periphery of rotary interlock 34 is rotatable relative to the inner socket support cylinder 16. The rotary interlock 34 is rotatably supported with a cap 27 through a bearing 31. The cap 27 is screwed to the lever head 15. The inner circumference of the rotary interlock 34 is rotatably supported with the fitting end 22 of the inner socket support cylinder 16 through a needle bearing 33. A base end of the rotary interlock 34 is provided with a bevel gear 29.

An inner socket 7 has a circular cross section, is concentrically arranged in the socket body 5, and is supported so as not to rotate relative to the tool body 3. The inner socket 7 has a recess 35 and inner serrations 37 serving as a stopping part to receive an engaging part formed at a front end of a bolt and stop the rotation of the bolt. More precisely, the front end of the inner socket 7 has a recess 35. The inner circumferential face of the recess 35 is provided with the inner serrations 37.

Along the axis of the inner socket 7, there is a sensor pass hole 39. The inner socket 7 can pass through the inner socket pass hole 23 into the nut receiver 19. A base end of the inner socket 7 is provided with male splines 41 that engage with the inner splines 17 of the inner socket support cylinder 16.

With the splines engaged, the inner socket 5 is nonrotatable with respect to the inner socket support cylinder 16 and axially movable relative to the same.

A base end face of the inner socket 7 has a spring washer hole 52. Between the base end face of the inner socket 7 and the back wall of the inner socket support cylinder 16, there is a socket spring 43 serving as a socket pusher.

The sensor pass hole 39 of the inner socket 7 supports the ultrasonic sensor 11 so that the ultrasonic sensor 11 is axially movable. Namely, the ultrasonic sensor 11 is supported with the tool body 3 through the inner socket 7. A front end of the ultrasonic sensor 11 is in the recess 35 of the inner socket 7. The ultrasonic sensor 11 emits and receives ultrasonic waves when the ultrasonic sensor 11 is in contact with a front end of a bolt, to detect an axial force acting on the bolt.

An intermediate part of the ultrasonic sensor 11 is provided with an integral spring washer 54. The spring washer 54 removably engages with the spring washer hole 52. Between the spring washer 54 and the spring support hole 18 of the inner socket support cylinder 16, there is a sensor spring 45 serving as a pusher. The sensor spring 45 pushes the ultrasonic sensor 11 toward a bolt 53.

The ultrasonic sensor 11 has a lead wire 46, which is passed through the sensor spring 45, the spring support hole 18, the through hole 30, and a grommet 50 attached to the through hole 30 to the outside of the lever head 15. Then, the lead wire 46 is connected to the controller (not shown) for computing an axial force. The lead wire 46 is attached to an outer face of the lever 13 with bands 56.

The driver 9 includes a drive shaft 47, a bevel gear mechanism 49, and the electric motor. The drive shaft 47 is arranged inside the lever 13 of the tool body 3 and is rotatably supported with the lever 13 through a needle bearing 58 and the like. The drive shaft 47 is driven by the motor.

The bevel gear mechanism 49 is arranged between the drive shaft 47 and the socket body 5, to transmit the rotation of the drive shaft 47 to the socket body 5 through meshing gears of the bevel gear mechanism 49. The meshing gears of the bevel gear mechanism 49 include a bevel gear 29 of the socket body 5 and a bevel gear 51 arranged at an end of the drive shaft 47. The bevel gears 29 and 51 mesh with each other.

The axial-force-detective fastening tool 1 can be disassembled by loosening the nut 28 and by removing the cap 27 from the lever head 15 into the inner socket support cylinder 16, socket body 5, and inner socket 7 as an unit. Therefore, the socket body 5, inner socket 7, and the like can easily be repaired, inspected, and replaced.

The axial-force-detective fastening tool 1 is used as shown in FIG. 3.

Figure 3A:
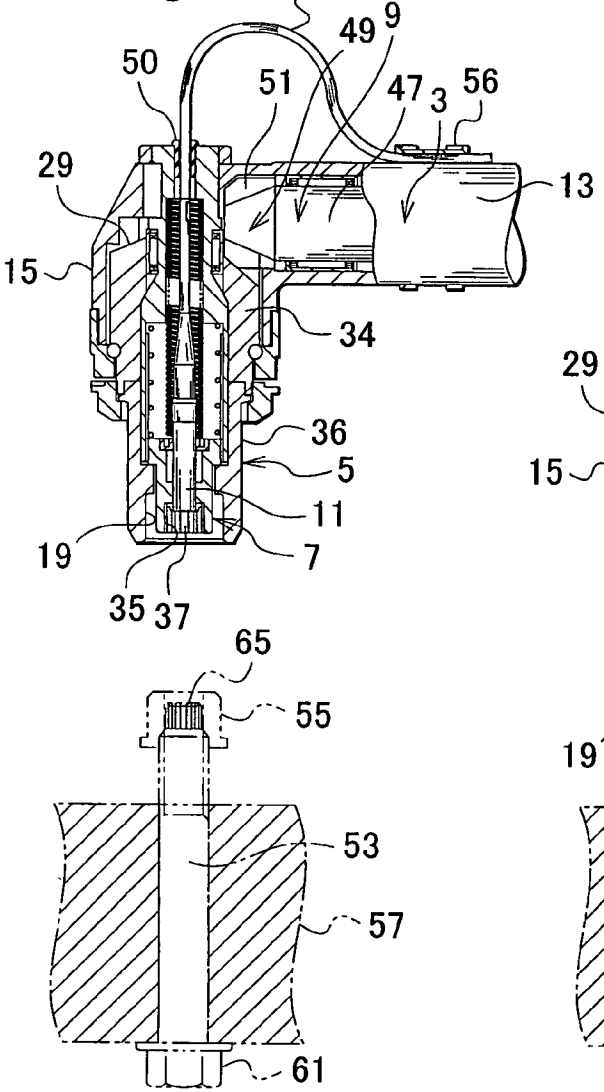
Figure 3B:
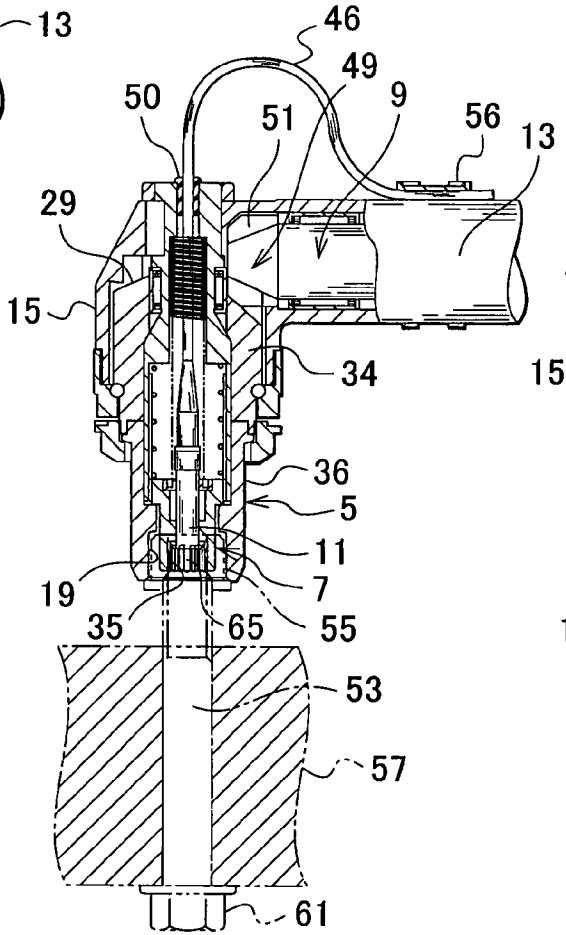
Figure 3C:
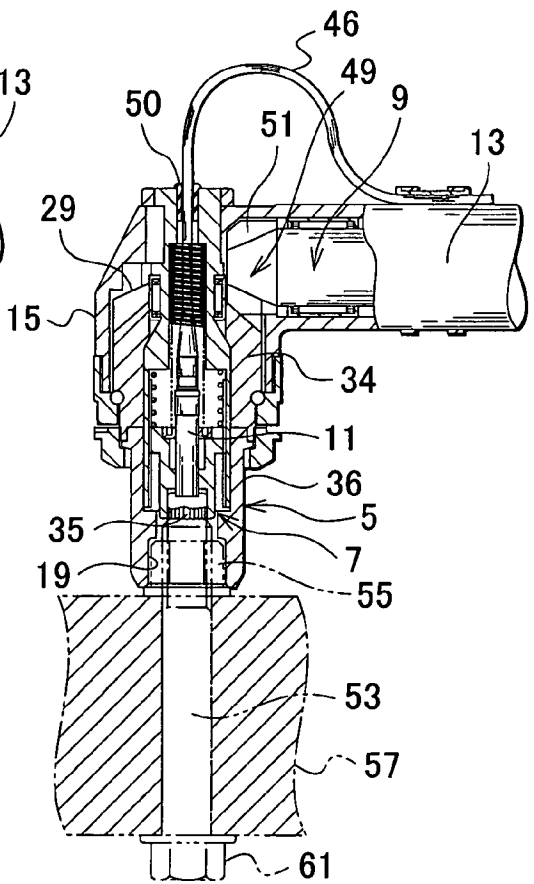

FIGS. 3A to 3C are views showing a fastening operation of the fastening tool according to the first embodiment in which FIG. 3A shows the tool before setting, FIG. 3B shows the tool set on a nut to fasten, and FIG. 3C shows the tool upon the completion of fastening. In FIGS. 3A to 3C, a nut 55 is fastened to a bolt 53 to fix an object 57 which may be an assembly of a knuckle arm and a boss of a suspension strut.

The bolt 53 has a head 61 at one end thereof. At a front end of a male thread 63 of the bolt 53 (a front end of the bolt 53), there is a pintail 65 serving as an engaging part. The pintail 65 has rotation stopping serrations. The nut 55 is set on the male thread 63. Under this state, the nut 55 is fastened to the bolt 53. For this, the fastening tool 1 is arranged as shown in FIGS. 3A and 3B so that the nut 55 is received in the nut receiver 19 of the socket body 5. At this time, the recess 35 of the inner socket 7 engages with the pintail 65 through the serrations, and the front end of the ultrasonic sensor 11 comes in contact with the front end face of the bolt 53.

In FIG. 3B, the motor of the tool body 3 is driven, and the controller instructs the ultrasonic sensor 11 to emit ultrasonic waves.

The motor drives the drive shaft 47, which turns the socket body 5 through the bevel gears 51 and 29. The inner socket 7 is nonrotatably fixed to the inner socket support cylinder 16 of the tool body 3, and therefore, the inner socket 7 is stationary while the socket body 5 rotates around the inner socket 7.

The rotation of the socket body 5 rotates the nut 55 through the nut receiver 19 to fasten the nut 55 to the bolt 53. At this time, the pintail 65 of the bolt 53 is engaged with the recess 35 of the inner socket 7 through the serrations, so that the bolt 53 does not rotate relative to the tool body 3. Accordingly, the socket 5 can surely fasten the nut 55 to the bolt 53 while the bolt 53 is nonrotatably held.

When the nut 55 is fastened to the bolt 53, the front end of the bolt 53 having the pintail 65 protrudes from the nut 55 toward the inner socket 7. Then, the inner socket 7 retracts against the pushing force of the socket spring 43, and the ultrasonic sensor 11 also retracts against the pushing force of the sensor spring 45. This results in securing the serration engagement between the inner socket 7 and the pintail 65 to surely prevent the rotation of the bolt 53 and keep the ultrasonic sensor 11 attached to the front end face of the bolt 53.

Ultrasonic waves emitted from the ultrasonic sensor 11 are reflected by an end face of the head 61 of the bolt 53 and are received by the ultrasonic sensor 11. According to the emitted and received ultrasonic waves, the controller measures an elapsed time between the emission of the ultrasonic waves and the reception of the same as a round-trip time of the ultrasonic waves along an axial length of the bolt 53 and computes the axial length of the bolt 53.

Thereafter, the controller computes an axial length extension ratio of the bolt 53 due to the fastening of the nut 55 as well as an axial force proportional to the extension ratio and outputs the axial force to, for example, a display. The operator sees the axial force on the display, and if the axial force is equal to a set value, stops the motor. Alternatively, the controller may automatically stop the motor if the computed axial force is equal to a predetermined value. Then, in FIG. 3C, an object 57, for example, an assembly of a boss of a suspension strut and a knuckle arm is correctly fastened with the bolt 53 and nut 55 at the set axial force.

As explained above, the axial-force-detective fastening tool 1 according to the first embodiment of the present invention supports the ultrasonic sensor 11 with the tool body 3. The ultrasonic sensor 11 is movable along the axis of the socket body 5, to come in contact with the front end of the bolt 53. The ultrasonic sensor 11 emits ultrasonic waves to the bolt 53 and receives the ultrasonic waves reflected by the bolt 53. The emitted and received ultrasonic waves are used to compute an axial force acting on the bolt 53. The fastening tool 1 also has the sensor spring 45 to push the ultrasonic sensor 11 toward the front end of the bolt 53. When the socket body 5 is rotated around the axis thereof to fasten the nut 55 to the bolt 53, the ultrasonic sensor 11 never rotates relative to the bolt 53. This prevents the breakage of the ultrasonic sensor 11 and improves the durability thereof.

The ultrasonic sensor 11 is correctly resiliently brought into contact with the front end of the bolt 53 due to the pushing force of the sensor spring 45, to correctly measure an axial force acting on the bolt 53.

When the nut 55 is fastened to the bolt 53, the front end of the bolt 53 may protrude from the nut 55 toward the ultrasonic sensor 11. At this time, the ultrasonic sensor 11 retracts toward the tool body 3 against the pushing force of the sensor spring 45, so that the nut 55 is properly fastened to the bolt 53 while axial force detection is correctly being carried out.

The ultrasonic sensor 11 is supported with the tool body 3, and therefore, the lead wire 46 extend from the tool body 3 is directly connected to the ultrasonic sensor 11 without a slip ring. This improves the durability of the fastening tool 1.

Between the tool body 3 and the socket body 5, there is no stationary member. Even if the nut 55 is located at the back of a narrow space, the front end of the socket body 5 can be inserted into the narrow space by grasping the tool body 3 and the nut receiver 19 can be set on the nut 55 to fasten the nut 55 to a bolt and detect an axial force acting on the bolt. This greatly improves workability.

The inner socket 7 is nonrotatably supported with the tool body 3 and is concentrically arranged in the socket body 5. The inner socket 7 has the recess 35 that nonrotatably receives the pintail 65 of the front end of the bolt 53 through serrations. The ultrasonic sensor 11 is supported to be axially movable in the inner socket 7. The inner socket 7 prevents the bolt 53 from rotating relative to the tool body 3. The driver 9 rotates the socket body 5 to easily fasten the nut 55 to the bolt 53.

The inner socket 7 is supported with the tool body 3 and is axially movable. The inner socket 7 is pushed toward the bolt 53 by the socket spring 43. When the nut 55 is fastened to the bolt 53, the front end of the bolt 53 protrudes from the nut 55 toward the inner socket 7. At this time, the inner socket 7 moves against the pushing force of the socket spring 43. As a result, the inner serrations 37 of the inner socket 7 keep engaging with the rotation stopping serrations of the pintail 65 of the front end of the bolt 53 and stopping the rotation of the bolt and the nut receiver 19 keeps holding the nut 55 during the nut fastening work and the axial force detecting operation.

The inner socket 7 is connected to the tool body 3 through splines, and therefore, the inner socket 7 can correctly move and be prevented from the rotation.

The recess 35 of the inner socket 7 and the pintail 65 at the front end of the bolt 53 have serrations, so that the engagement between the front end of the bolt 53 and the inner socket 7 to stop the rotation of the bolt 53 can be easy and correct.

The driver 9 consists of the drive shaft 47 driven by the motor and the bevel gear mechanism 49 that is interposed between the drive shaft 47 and the socket body 5 and transmits the rotation of the drive shaft 47 to the socket body 5 through meshing gears. With this arrangement, the motor can surly turn the socket body 5 through the drive shaft 47 and bevel gear mechanism 49. At the same time, the axial rotation of the bolt 53 is prevented, the nut 55 is easily fastened to the bolt 53, and an axial force acting on the bolt 53 is properly detected.

When detecting an axial force acting on the bolt 53, the ultrasonic sensor 11 must correctly be brought into contact with the bolt 53 along the axis of the bolt 53 and ultrasonic waves emitted from the ultrasonic sensor 11 must correctly be reflected by the end face of the head 61 of the bolt 53. For this, the bolt 53 has a configuration shown in FIG. 4.

Figure 4:
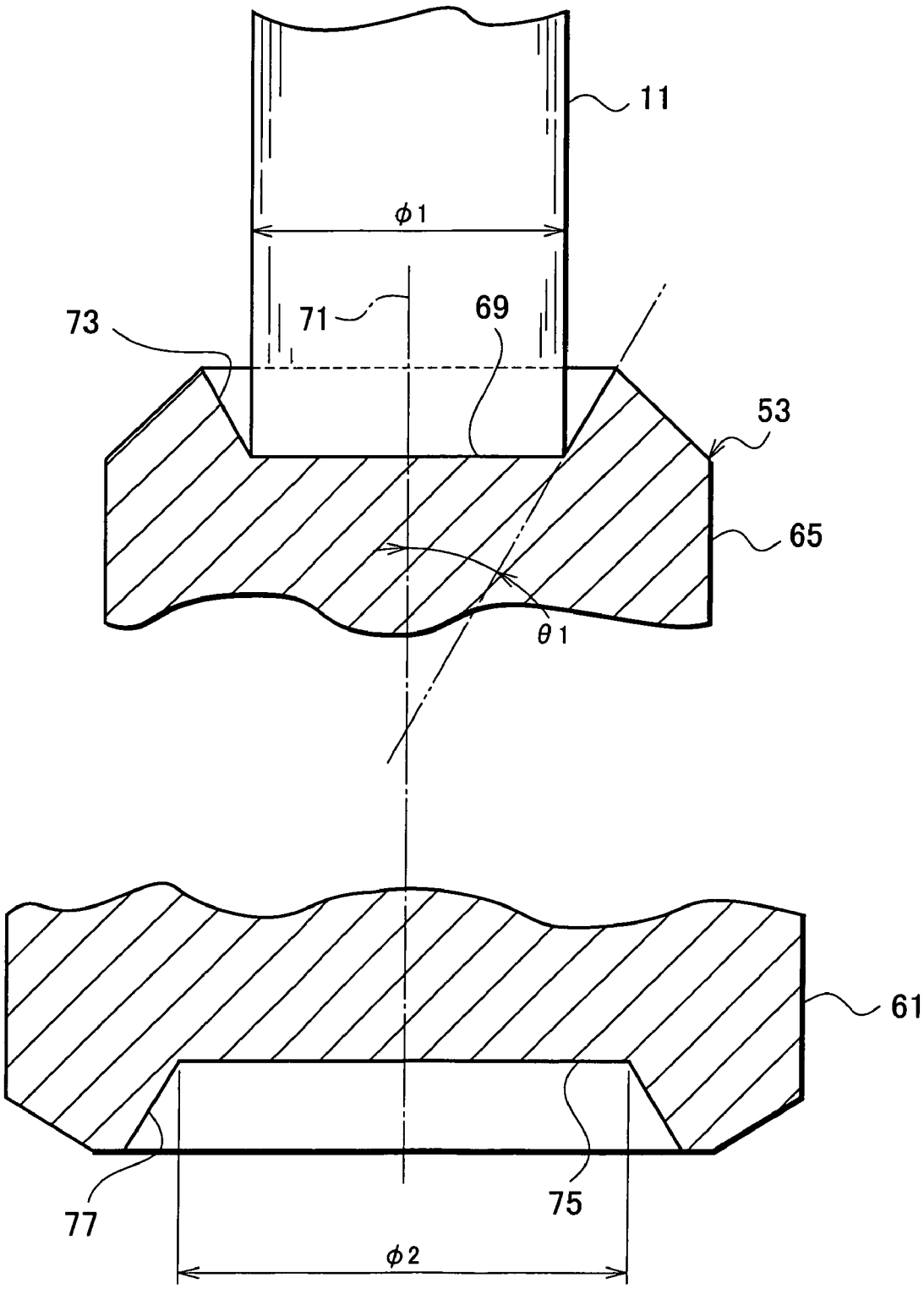
FIG. 4 is an enlarged sectional view showing both ends of a bolt according to an embodiment of the present invention.

FIG. 4 is an enlarged sectional view showing both ends of the bolt 53. Namely, FIG. 4 shows the pintail 65 and head 61 of the bolt 53. In FIG. 4, the pintail 65 of the bolt 53 has a front reference face 69 that is circular around an axis 71 of the bolt 53 and is orthogonal to the axis 71.

The front reference face 69 has a diameter ϕA that is substantially equal to or greater than the diameter of the ultrasonic sensor 11. The front reference face 69 is surrounded with a slanted face 73 having a slant angle è1 of about 30° with respect to the axis 71 of the bolt 53. The slanted face 73 encircles the bolt axis 71. When the ultrasonic sensor 11 is moved toward the front reference face 69, the ultrasonic sensor 11 may slightly be eccentric. Even in such a case, the slanted face 73 guides the ultrasonic sensor 11 so that the end face of the ultrasonic sensor 11 may correctly be brought into contact with the front reference face 69. Namely, the slanted face 73 can correctly position the front end face of the ultrasonic sensor 11 on the front reference face 69. Since the ultrasonic sensor 11 is correctly brought into contact with the front reference face 69, an axial force acting on the bolt 53 is correctly detectable.

When the nut 55 is fastened to the bolt 53, the slanted face 73 prevents the ultrasonic sensor 11 from shifting in a circumferential direction. Accordingly, the axial force detection can correctly be continued during the fastening of the nut 55.

The head 61 of the bolt 53 is provided with a head reference face 75 that is opposite to the front reference face 69 and reflects ultrasonic waves. Like the front reference face 69, the head reference face 75 is circular around the axis 71 and is orthogonal to the axis 71.

The head reference face 75 has a diameter ϕB that is greater than the diameter of the front reference face 69. The size of the head reference face 75 is expanded according to the size of the bolt head 61 to increase an area for reflecting ultrasonic waves and surely detect an axial force. Around the head reference face 75, there is a slanted face 77.

A nut is fastened to the bolt 53 with the axial-force-detective fastening tool 1. The front end of the bolt 53 has the front reference face 69 that is substantially orthogonal to the axis 71 of the bolt 53 and receives the ultrasonic sensor 11. Around the front reference face 69, there is the slanted face 73 to position the ultrasonic sensor 11 onto the front reference face 69. As a result, the ultrasonic sensor 11 is pushed by the sensor spring 45 and is correctly brought into contact with the front reference face 69 of the bolt 53. Under this state, the slanted face 73 around the front reference face 69 prevents the ultrasonic sensor 11 from moving in a direction orthogonal to the axis 71. This results in correctly detecting an axial force working on the bolt 53.

The head 61 of the bolt 53 is provided with the head reference face 75 that is opposite to the front reference face 69 and reflects ultrasonic waves. Namely, the head reference face 75 correctly reflects ultrasonic waves emitted from the ultrasonic sensor 11, to correctly detect an axial force acting on the bolt 53.

The bolt 53 is formed by cold forging. During the cold forging, the front reference face 69, slanted face 73, head reference face 75, and slanted face 77 are formed.

Figures 5A, 5B, 5C, 5D, 5E:
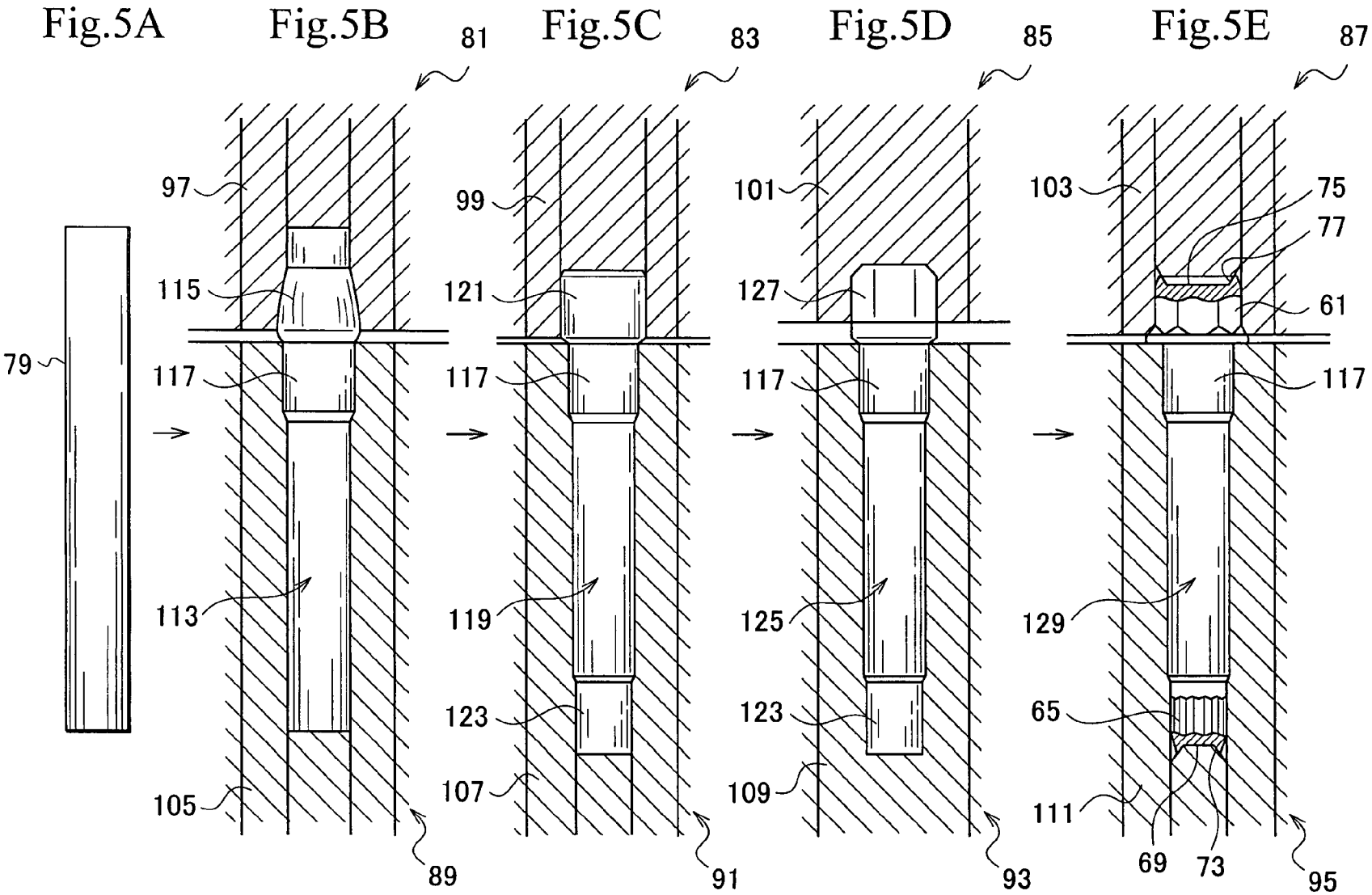

FIG. 5A to 5E are views showing a method of manufacturing a bolt by cold forging according to an embodiment of the present invention in which FIG. 5A shows a bolt base material cut from a linear material, FIG. 5B shows a first process of the cold forging, FIG. 5C shows a second process of the cold forging, FIG. 5D shows a third process of the cold forging, and FIG. 5E shows a fourth process of the cold forging.

In FIG. 5A, a bolt base material 79 is cut from a linear material. Cold forging is carried out through the first process of FIG. 5B to the fourth process of FIG. 5E to form the bolt 53.

The first to fourth processes employ upper molds 81, 83, 85, and 87 and lower molds 89, 91, 93, and 95, respectively. The upper molds 81, 83, 85, and 87 employ punches 97, 99, 101, and 103, respectively, and the lower molds employ dies 105, 107, 109, and 111, respectively.

The process of FIG. 5A forms the base material 79 from a linear material.

In the first process of FIG. 5B, the upper mold 81 is moved toward the lower mold 89 to cold-forge the base material 79 into a first semifinished product 113. The semifinished product 113 has an enlarged part 115 corresponding to the head 61 of the bolt 53 and a diameter extended part 117 corresponding to a bolt base.

In the second process of FIG. 5C, the upper mold 83 is moved toward the lower mold 91 to cold-forge the first semifinished product 113 into a second semifinished product 119. The second semifinished product 119 has an enlarged part 121 formed from the enlarged part 115 and a reduced diameter part 123 corresponding to the front end pintail 65.

In the third process of FIG. 5D, the upper mold 85 is moved toward the lower mold 93 to cold-forge the second semifinished product 119 into a third semifinished product 125. The third semifinished product 125 has a hexagonal part 127 whose axial size is slightly greater than that of the finished head 61.

In the fourth process of FIG. 5E, the upper mold 87 is moved toward the lower mold 95 to cold forge the third semifinished product 125 into a fourth semifinished product 129. The fourth semifinished product 129 has the pintail 65, the front reference face 69 and slanted face 73 formed at a front end of the pintail 65, and the head reference face 75 and slanted face 77 formed on the head 61.

On the fourth semifinished product 129, a male thread is formed by, for example, rolling. Thereafter, the semifinished product is heat-treated and is plated to provide the bolt 53.

In this way, the bolt 53 to be fastened with the axial-force-detective fastening tool 1 is provided with the front reference face 69, slanted face 73, head reference face 75, and slanted face 77. These faces are formed when the bolt 53 is cold-forged. Accordingly, the front reference face 69, slanted face 73, head reference face 75, and slanted face 77 are easily correctly producible.

According to the above-mentioned embodiment, the bolt 53 is provided with the front reference face 69, slanted face 73, head reference face 75, and slanted face 77. Alternatively, the bolt may be provided with only the front reference face 69 and slanted face 73, or may be provided with none of them.

In the above embodiment, the inner socket 7 is movable along the inner socket support cylinder 16 of the tool body 3. Instead, the inner socket 7 may be fixed to the same.

In the above embodiment, the bolt 53 is provided with the pintail 65 having the rotation stopping serrations and the inner socket 7 of the fastening tool 1 is provided with the recess 35 having the inner serrations 37. If the bolt 53 is a screw stud for fastening, for example, an engine cylinder head, the pintail 65 having the rotation stopping serrations and the recess 35 having the inner splines may be omitted. In this case, the inner socket 7 itself may be omitted, and the ultrasonic sensor 11 may directly movably supported with, for example, the inner socket support cylinder 16 or the like of the tool body 3.

The sensor spring 45 may be configured to serve as the socket spring 43. In this case, the socket spring 43 may be omitted.

The axial-force-detective fastening tool 1 according to the first embodiment is also applicable to fastening a bolt to a nut, fastening a bolt to a block, and the like.

Figure 6:
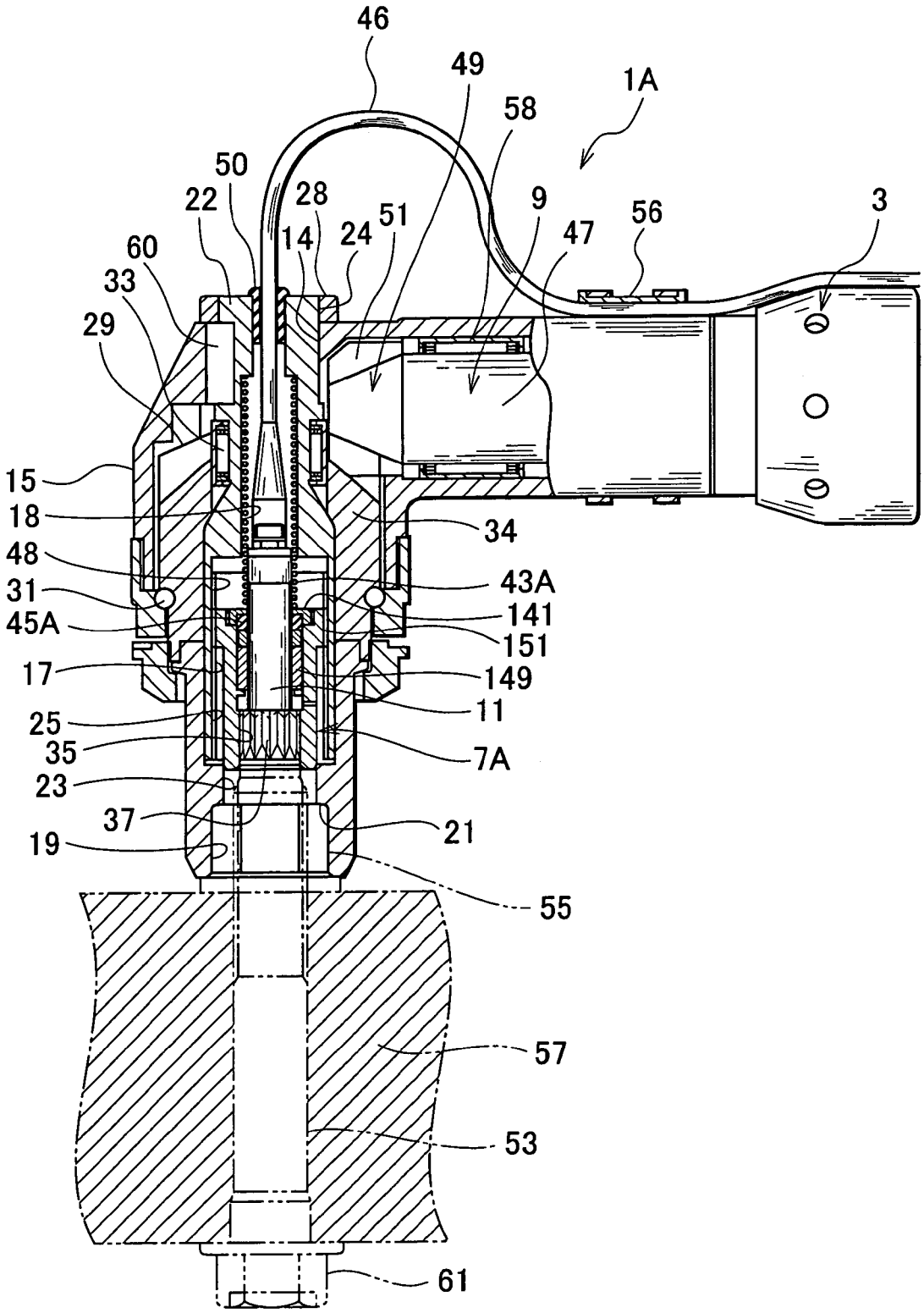
FIG. 6 is a sectional view showing essential part of an axial-force-detective fastening tool according to a second embodiment of the present invention.
Figure 7:
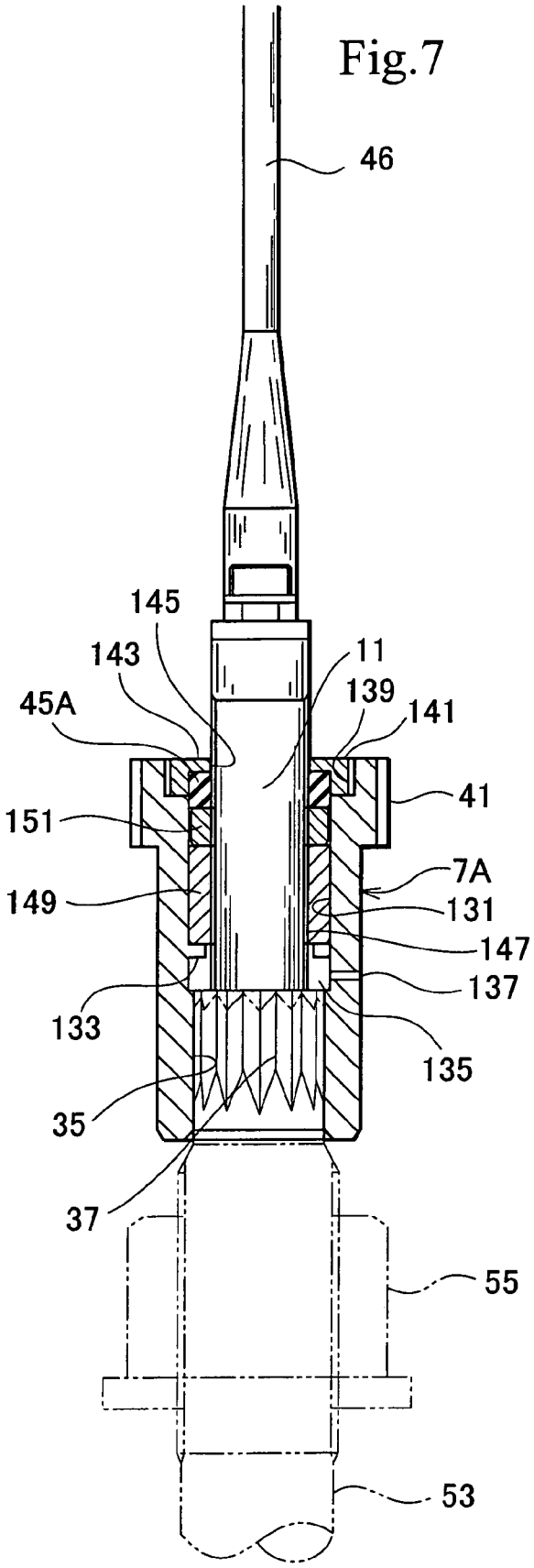
FIG. 7 is an enlarged sectional view showing the essential part shown in FIG. 6.

FIGS. 6 and 7 are views showing an axial-force-detective fastening tool according to the second embodiment of the present invention in which FIG. 6 is a sectional view showing essential part of the tool and FIG. 7 is an enlarged sectional view showing the essential part. A basic structure of the tool according to the second embodiment is the same as that of the first embodiment, and therefore, the same or corresponding parts are represented with the same reference marks or marks added with "A."

The axial-force-detective fastening tool 1A according to the second embodiment has a cushion rubber 45A serving as a pusher between an ultrasonic sensor 11 and an inner socket 7A. The inner socket 7A has a guide hole 131. An end of the guide hole 131 has a stopper 133. The stopper 133 stops a slider (to be explained later). Between the stopper 133 and a recess 35, there is a space 135 that communicates with the outside through a hole 137 formed through the inner socket 7A. An end face of the inner socket 7A has a female thread 139.

The female thread 139 receives a lid 141. The lid 141 has a seat 143 having a through hole 145 for freely passing the ultrasonic sensor 11.

An outer circumferential face of the ultrasonic sensor 11 has a male thread 147. The ultrasonic sensor 11 screws the male thread 147 to the slider 149, and thereby, the male thread 147 engages with the slider 149. The position of the slider 149 relative to the ultrasonic sensor 11 is determined by a lock nut 151. Namely, the slider 149 is fixed to the ultrasonic sensor 11 and is slidable along the guide hole 131 of the inner socket 7A. The shape of each of the slider 149 and lock nut 151 may be circular, hexagonal, or any other. The shape of the guide hole 131 may also be circular, hexagonal, or any other so that the slider 149 may slide along the guide hole 131.

The cushion rubber 45A is interposed between the lock nut 151 of the slider 149 and the seat 143 of the lid 141.

According to the second embodiment, a socket spring 43A instead of a sensor spring is arranged between the lid 141 and a spring support hole 18 of an inner socket support cylinder 16.

In fastening work, the ultrasonic sensor 11 is brought into contact with a front reference face 69 of a bolt 53. At this time, the ultrasonic sensor 11 retracts due to contact force, and the slider 149 slides along the guide hole 131 according to the retraction of the ultrasonic sensor 11. The retraction of the ultrasonic sensor 11 is carried out against the pushing force of the cushion rubber 45A.

Accordingly, the ultrasonic sensor 11 can correctly be brought into contact with the front reference face 69 of the bolt 53, to correctly detect an axial force acting on the bolt 53.

According to the second embodiment, the lock nut 151 may be loosened to adjust the position of the fastened position of the slider 149 to thereby adjust an initial pushing force of the cushion rubber 45A.

Figure 8:
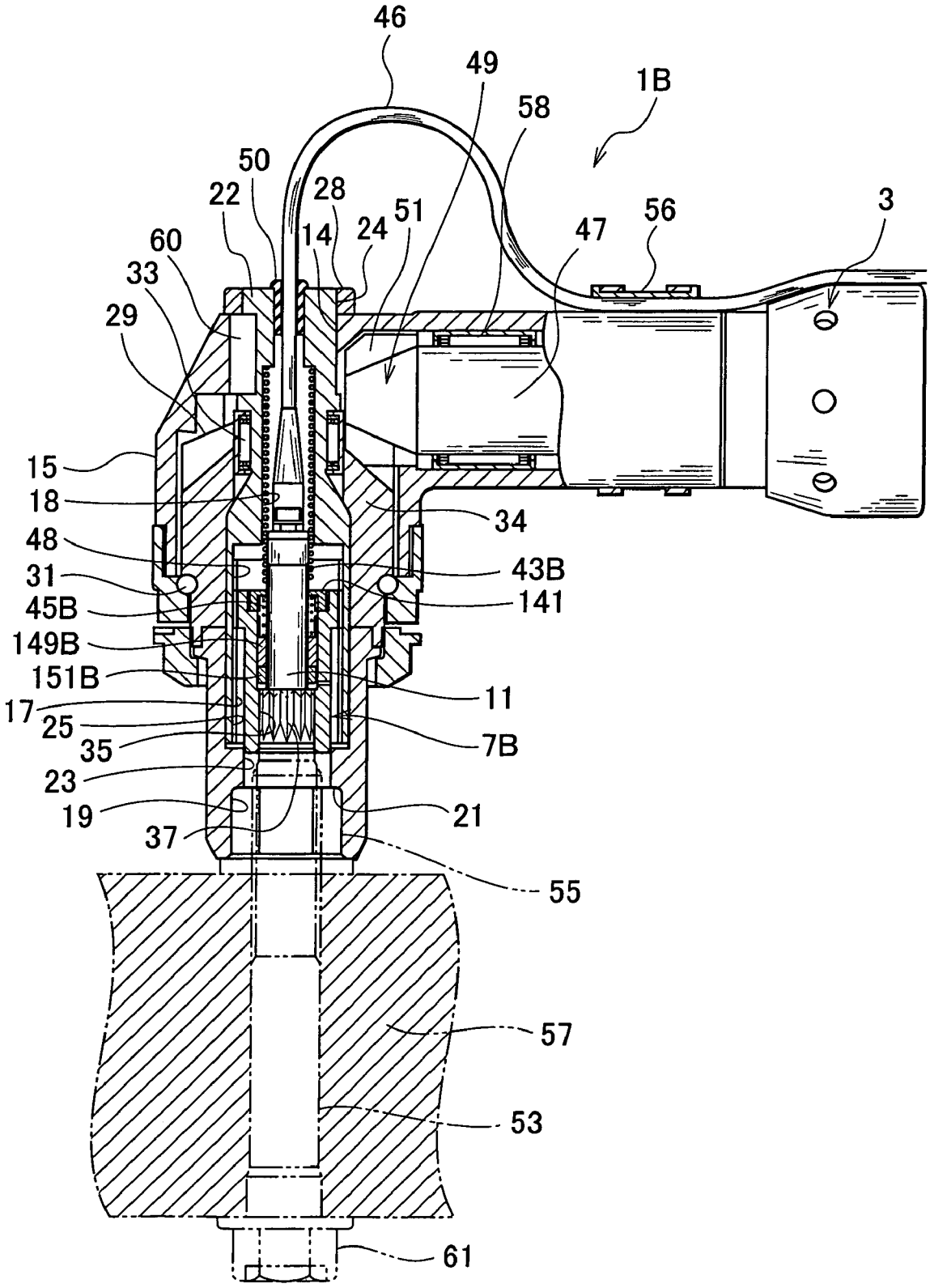
FIG. 8 is a sectional view showing essential part of an axial-force-detective fastening tool according to a third embodiment of the present invention.
Figure 9:
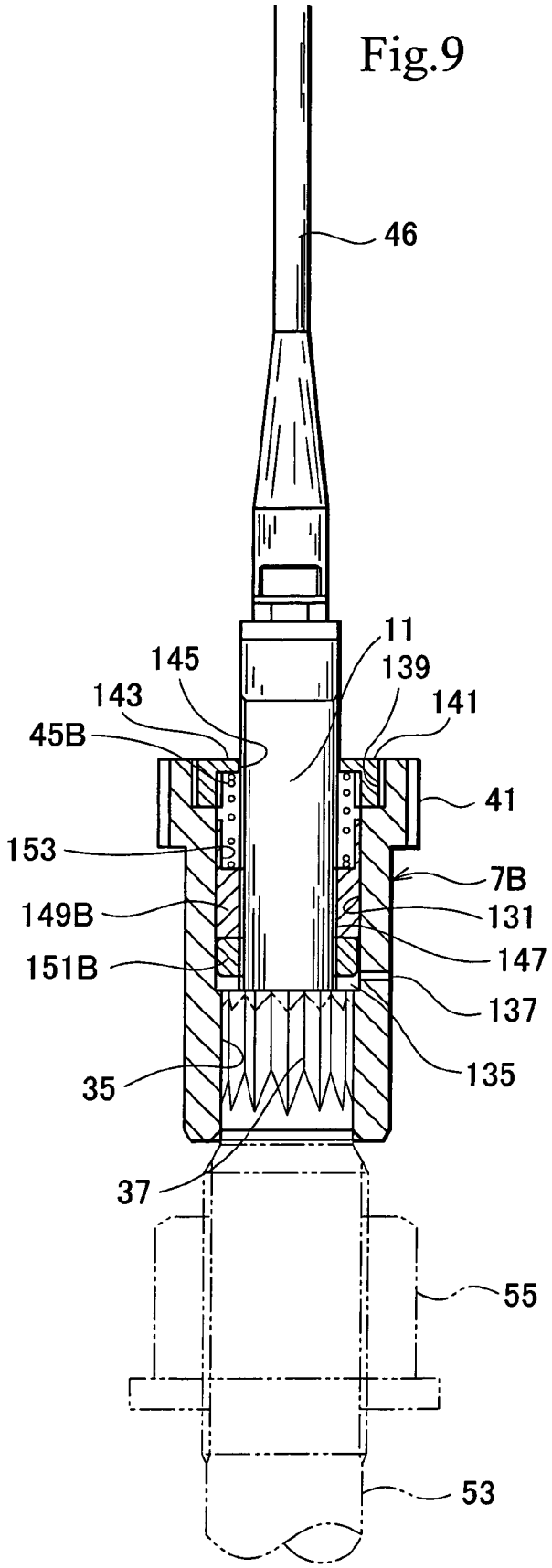
FIG. 9 is an enlarged sectional view showing the essential part shown in FIG. 8.

FIGS. 8 and 9 are views showing an axial-force-detective fastening tool according to the third embodiment of the present invention in which FIG. 8 is a sectional view showing essential part of the tool and FIG. 9 is an enlarged sectional view showing the essential part. A basic structure of the third embodiment is the same as that of the second embodiment, and therefore, the same or corresponding parts of the third embodiment are represented with the same numerals, or the same numerals added with "B," or the same numerals with "B" instead of "A."

The axial-force-detective fastening tool 1B according to the third embodiment employs a coil spring 45B instead of the cushion rubber 45A of the second embodiment.

The positions of slider 149B and lock nut 151B are opposite to those of the second embodiment, so that the slider 149B directly receives the coil spring 45B. The slider 149B is provided with a spring receiving recess 153. Between the recess 153 and a seat 143 of a lid 141, the coil spring 45B is interposed.

The third embodiment provides substantially the same effect as the second embodiment.

The third embodiment can increase a retraction stroke of an ultrasonic sensor 11. In addition, the third embodiment can increase an adjustable range of initial pushing force of the coil spring 45B by adjusting the position of the slider 149B.

Figure 10:
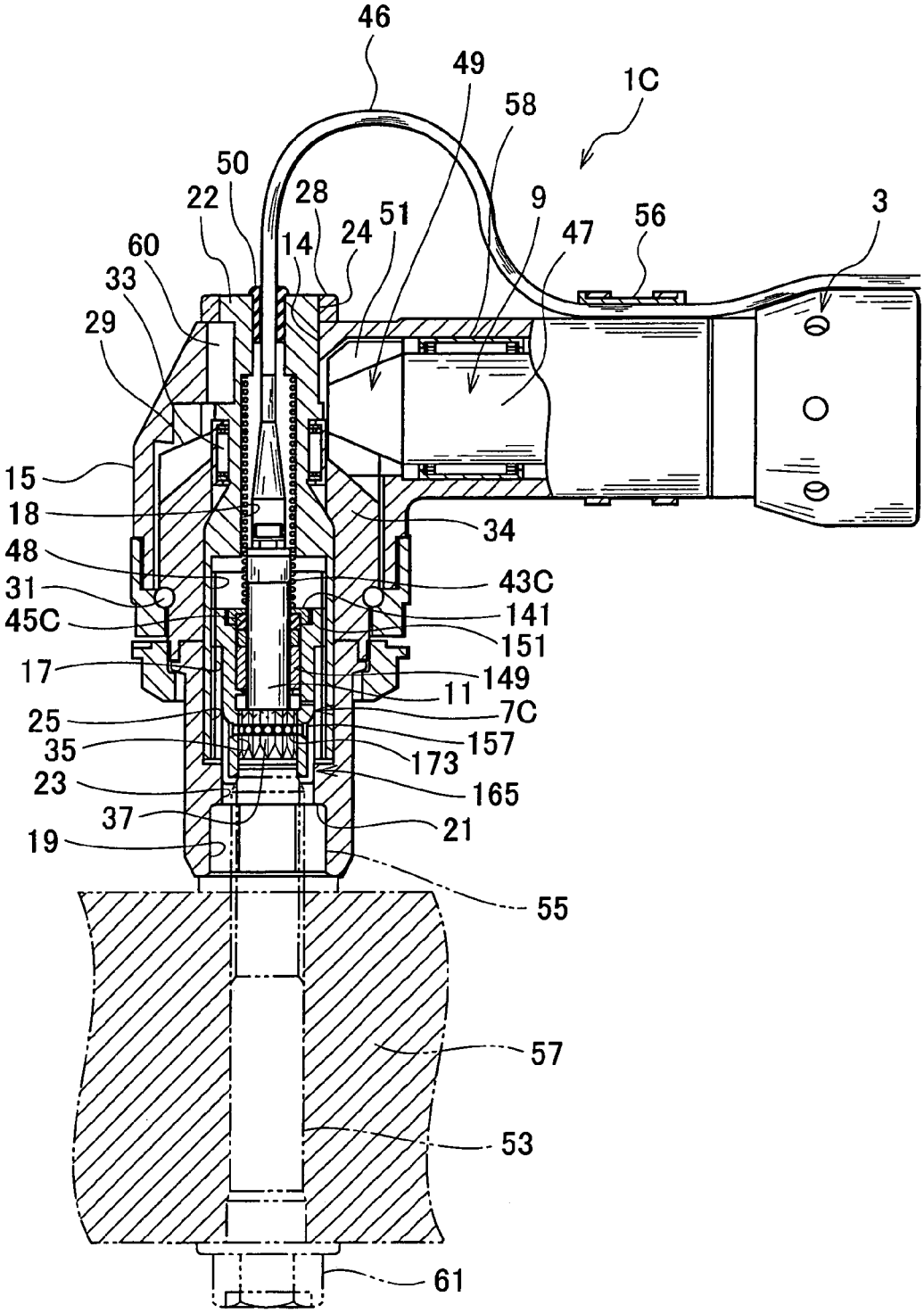
FIG. 10 is a sectional view showing essential part of an axial-force-detective fastening tool according to a fourth embodiment of the present invention.
Figure 11:
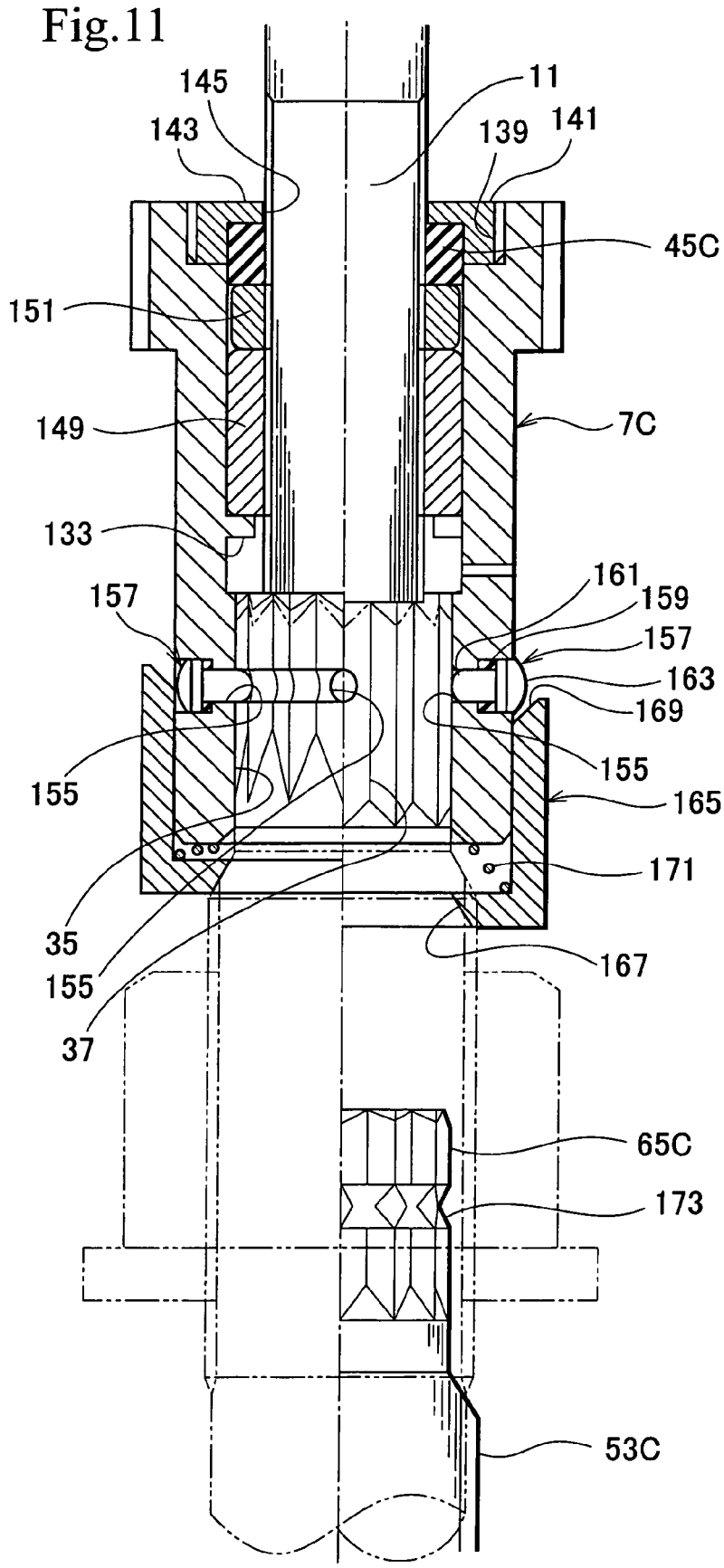
FIG. 11 is an enlarged sectional view showing the essential part shown in FIG. 10.
Figure 12:
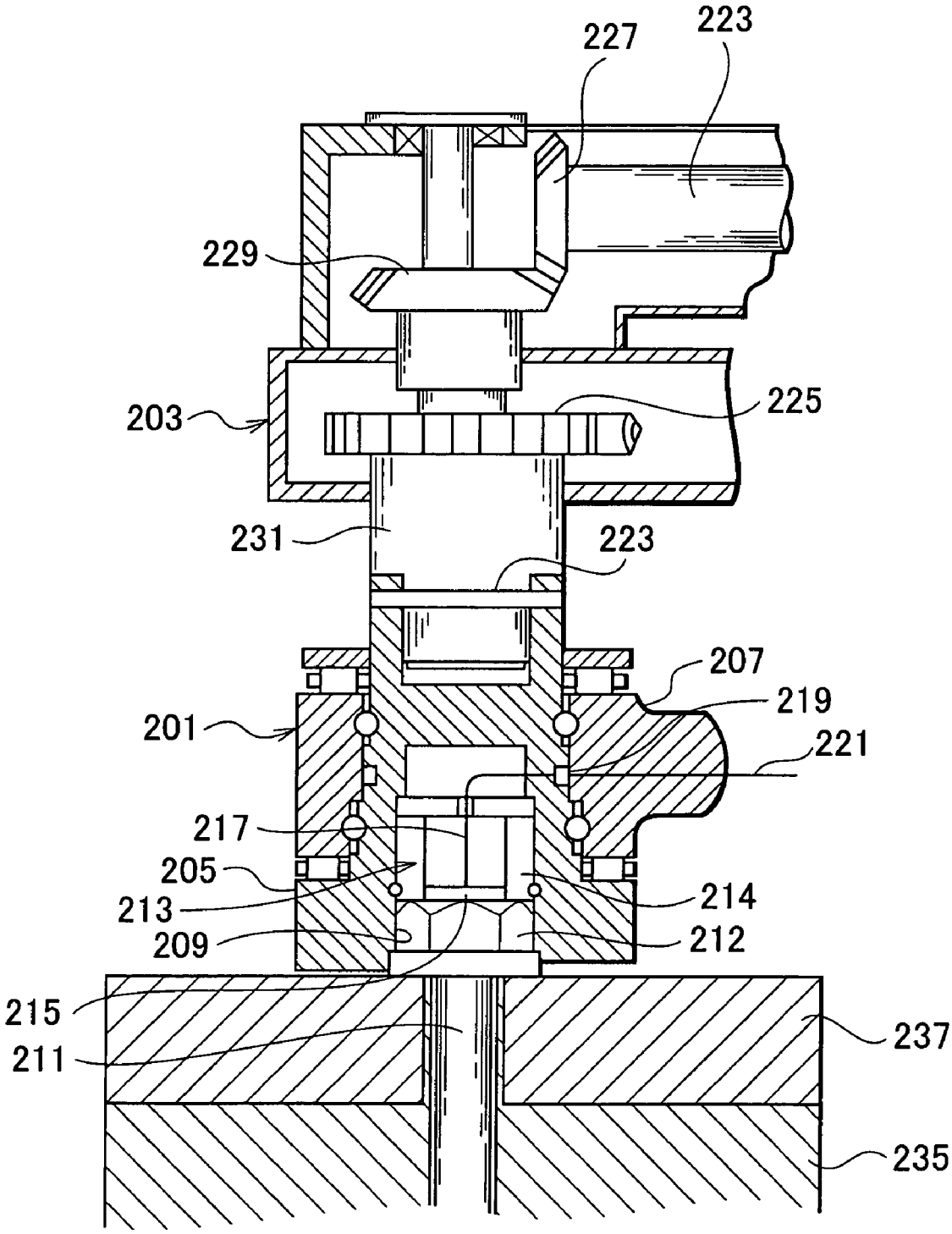
Fig.12 RELATED ART
FIG. 12 is a sectional view showing an axial-force-detective fastening tool according to a related art and a bolt fastened with the tool.

FIGS. 10 and 11 show an axial-force-detective fastening tool according to the fourth embodiment of the present invention in which FIG. 10 is a sectional view showing essential part of the tool and FIG. 11 is an enlarged sectional view showing the essential part. A basic structure of the fourth embodiment is the same as that of the second embodiment, and therefore, the same or corresponding parts are represented with the same numerals, or the same numerals added with "C," or the same numerals added with "C" instead of "A."

The axial-force-detective fastening tool 1C according to the fourth embodiment enables an inner socket 7C and a bolt 53C to correctly and easily be positioned to each other.

The inner socket 7C is provided with stepped support holes 155 formed through the inner socket 7C from an outer face thereof to a stopping part thereof. Each support hole 155 movably supports a pin 157. For example, four of the combination of the support hole 155 and pin 157 are arranged at circumferential four positions spaced by 90° from each other. Between the support hole 155 and the pin 157, an elastic member, i.e., a rubber bush 159 is interposed to retract a front end 161 of the pin 157 from a recess 35 of the inner socket 7C and protrude an outer end 163 of the pin 157 from the outer face of the inner socket 7C. The front end 161 and outer end 163 of the pin 157 are rounded.

A front end of the inner socket 7C supports a movable cap 165. A front end of the movable cap 165 has a tapered through hole 167, and a rear end thereof has a tapered face 169. Between the movable cap 165 and the inner socket 7C, a coil spring 171 having a tapered shape is interposed.

The bolt 53C according to the fourth embodiment has a pintail 65C provided with a circumferential groove 173 to engage with the front end 161 of the pin 157.

In fastening work, the front end of the bolt 53C is inserted into the recess 35 through the through hole 167 of the movable cap 165. At this time, the front end face of the movable cap 165 abuts against an end face of a nut 55, and therefore, the movable cap 165 is pushed toward the inner socket 7C against the pressing force of the coil spring 171. As a result, the tapered face 169 of the movable cap 165 contacts the outer end 163 of each pin 157, and therefore, the pin 157 is gradually pushed inwardly by the tapered face 169. Namely, each pin 157 moves in the support hole 155 toward the recess 35 against the pressing force of the rubber bush 159.

Thereafter, the inner serrations 37 of the recess 35 of the inner socket 7C engage with the bolt 53C, and an ultrasonic sensor 11 is elastically brought into contact with a front reference face of the bolt 53C, like the second embodiment. At this time, the front end 161 of each pin 157 engages with the circumferential groove 173 of the bolt 53C to position the inner socket 7C relative to the bolt 53C.

In this way, the fourth embodiment can correctly position the inner socket 7C relative to the bolt 53C so that the ultrasonic sensor 11 is correctly brought into contact with the front end of the bolt 53C that is stopped by the inner serrations 37 of the inner socket 7C. This results in correctly detecting an axial force acting on the bolt 53C. Even if the axial-force-detective fastening tool 1C is manipulated with one hand, the tool 1C can correctly and easily detect the axial force.

When the inner socket 7C is removed from the bolt 53C, the circumferential groove 173 of the bolt 53C applies outward force to the front end 161 of each pin 157. This force is transmitted through the pin 157 to the tapered face 169 of the movable cap 165. At the same time, the movable cap 165 receives pushing force from the coil spring 171. As a result, the movable cap 165 moves so that the tapered face 169 moves out of the outer end 163 of each pin 157. Then, the pins 163 return to the outside positions of the inner socket 7C. At this time, the force of the rubber bush 159 retracts the front end 161 of each pin 157 from the inner serrations 37 of the recess 35. Namely, the outer end 163 of each pin 157 is protruded from the outer face of the inner socket 7C and is kept thereat.

In this way, even if an operator roughly handles the fastening tool 1C, the inner socket 7C can correctly be positioned relative to the bolt 53C and the ultrasonic sensor 11 can correctly elastically be brought into contact with the front end of the bolt 53C stopped at the inner serrations 37 of the inner socket 7C, to correctly measure an axial force acting on the bolt 53C.

What is claimed is:

1. An axial-force-detective fastening tool, comprising:

a tool body;

a socket body rotatably supported with the tool body and having a nut receiver, configured to receive a nut in the nut receiver, turn the nut around an axis of the socket body, and fasten the nut to a bolt;

a driver installed in the tool body, configured to drive and rotate the socket body;

an ultrasonic sensor supported with the tool body, configured to be movable along the axis of the socket body, be brought into contact with a front end of the bolt in the nut receiver, emit ultrasonic waves to the bolt, and receive the ultrasonic waves reflected from the bolt, so that an axial force acting on the bolt is detected according to the emitted and received ultrasonic waves;

a biasing device configured to push the ultrasonic sensor to the front end of the bolt; and an inner socket having a stopping part, nonrotatably supported with the tool body, concentrically arranged in the socket body, configured to stop the rotation of the bolt by holding, with the stopping part, an engaging part formed at the front end of the bolt, and configured to movably support the ultrasonic sensor.

2. The axial-force-detective fastening tool of claim 1, wherein the biasing device is interposed between the ultrasonic sensor and the inner socket.

3. The axial-force-detective fastening tool of claim 2, wherein the biasing device is interposed between a lid fixed to the inner socket and a slider fixed to the ultrasonic sensor, the slider being slidably guided in the inner socket.

4. The axial-force-detective fastening tool of claim 3, further comprising:

a support hole formed through the inner socket from an outer side face thereof to the stopping part thereof;

a pin supported in the support hole;

an elastic member to hold the pin so that a front end of the pin retracts from the stopping part and an outer end of the pin protrudes from the outer side face of the inner socket; and a movable member movably supported at a front end of the inner socket, the movable member being configured so that, when pressed toward the inner socket against pushing force, the movable member pushes the outer end of the pin toward the stopping part against the force of the elastic member so that the front end of the pin protrudes from the stopping part and engages with a side of the engaging part of the bolt.

5. The axial-force-detective fastening tool of claim 2, further comprising:

a support hole formed through the inner socket from an outer side face thereof to the stopping part thereof;

a pin supported in the support hole;

an elastic member to hold the pin so that a front end of the pin retracts from the stopping part and an outer end of the pin protrudes from the outer side face of the inner socket; and a movable member movably supported at a front end of the inner socket, the movable member being configured so that, when pressed toward the inner socket against pushing force, the movable member pushes the outer end of the pin toward the stopping part against the force of the elastic member so that the front end of the pin protrudes from the stopping part and engages with a side of the engaging part of the bolt.

6. The axial-force-detective fastening tool of claim 1, further comprising:

a support hole formed through the inner socket from an outer side face thereof to the stopping part thereof;

a pin supported in the support hole;

an elastic member to hold the pin so that a front end of the pin retracts from the stopping part and an outer end of the pin protrudes from the outer side face of the inner socket; and a movable member movably supported at a front end of the inner socket, the movable member being configured so that, when pressed toward the inner socket against pushing force, the movable member pushes the outer end of the pin toward the stopping part against the force of the elastic member so that the front end of the pin protrudes from the stopping part and engages with a side of the engaging part of the bolt.

7. The axial-force-detective fastening tool of claim 1, wherein the inner socket is supported so as to be movable relative to the tool body, and a socket is arranged so as to apply another biasing device to push the inner socket toward the bolt.

8. The axial-force-detective fastening tool of claim 7, wherein the inner socket engages with the tool body through splines.

9. The axial-force-detective fastening tool of claim 1, wherein the stopping part of the inner socket and the engaging part of the front end of the bolt are provided with serrations through which the stopping part and the engaging part engage with each other.

10. The axial-force-detective fastening tool of claim 1, wherein the driver includes:

a drive shaft driven and rotated by a motor; and a bevel gear mechanism arranged on the drive shaft and socket body and having meshing bevel gears to transmit the rotation of the drive shaft to the socket body.

* * * * *